US005141706A

United States Patent [19]

Clark

[11] Patent Number: 5,141,706

[45] Date of Patent: Aug. 25, 1992

[54] AIR PURIFICATION UNIT

[76] Inventor: Donald L. Clark, 760 Maple Rd., East Aurora, N.Y. 14052

[21] Appl. No.: 374,663

[22] Filed: Jun. 30, 1989

[51] Int. Cl.[5] ..... A62B 11/00

[52] U.S. Cl. ..... 422/122; 55/315; 55/316; 55/323; 422/5; 422/124

[58] Field of Search ..... 422/122, 124, 5; 55/315, 316, 318, 322, 323

[56] References Cited

U.S. PATENT DOCUMENTS

| | | | |
|---|---|---|---|
| 2,430,861 | 11/1947 | Carpenter et al. | 422/122 X |
| 2,603,468 | 11/1949 | Sutton | 422/124 X |
| 3,576,593 | 4/1971 | Cicirello | 422/124 X |
| 3,744,216 | 7/1973 | Halloran | 422/124 X |
| 3,804,942 | 4/1974 | Kato et al. | 422/122 |
| 4,102,656 | 7/1978 | Koritz | 422/124 |
| 4,191,543 | 3/1980 | Peters | 422/122 X |
| 4,229,415 | 10/1980 | Bryson | 422/124 X |
| 4,411,675 | 10/1983 | de Castella | 422/124 X |

*Primary Examiner*—Robert J. Warden

*Assistant Examiner*—Amalia L. Santiago

*Attorney, Agent, or Firm*—Joseph P. Gastel

[57] ABSTRACT

An air purification unit including a housing of substantially rectangular solid configuration and having an inlet and an outlet, a diagonal partition in the housing dividing it into substantially equal inlet and outlet chambers, first filters in communication with the inlet chamber for removing gases and particulate matter entering the inlet chamber, second filters in communication with the outlet chamber for removing submicron particles, and a specialized motorized impeller mounted on the diagonal partition for moving air from the inlet chamber to the outlet chamber, the motorized impeller including a stationary inlet ring secured to the partition, a stationary motor housing portion fixed relative to the partition and a rotatable motor housing portion carrying a backwardly rotatable impeller wheel for drawing air through the center of the impeller wheel as it rotates and forcing it radially outwardly through the impeller wheel to thereby pressurize air in the outlet chamber.

17 Claims, 5 Drawing Sheets

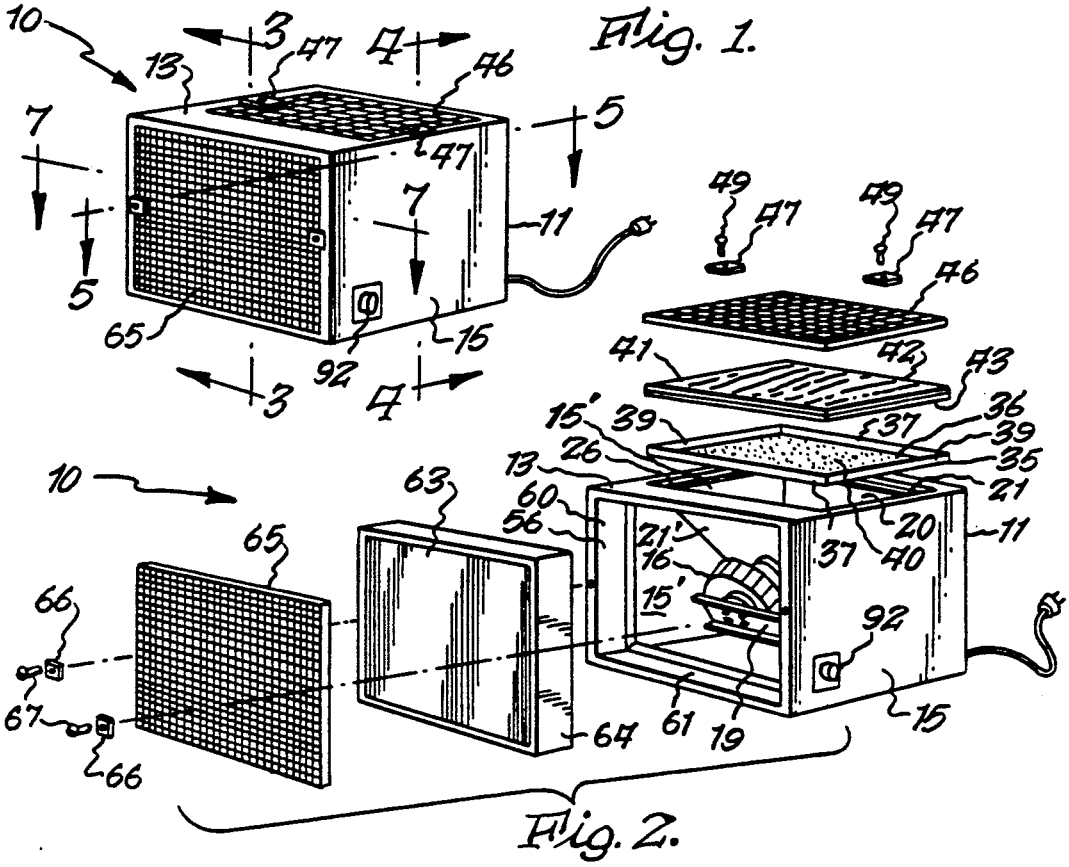
Fig. 1.
Fig. 2.
Fig. 3.
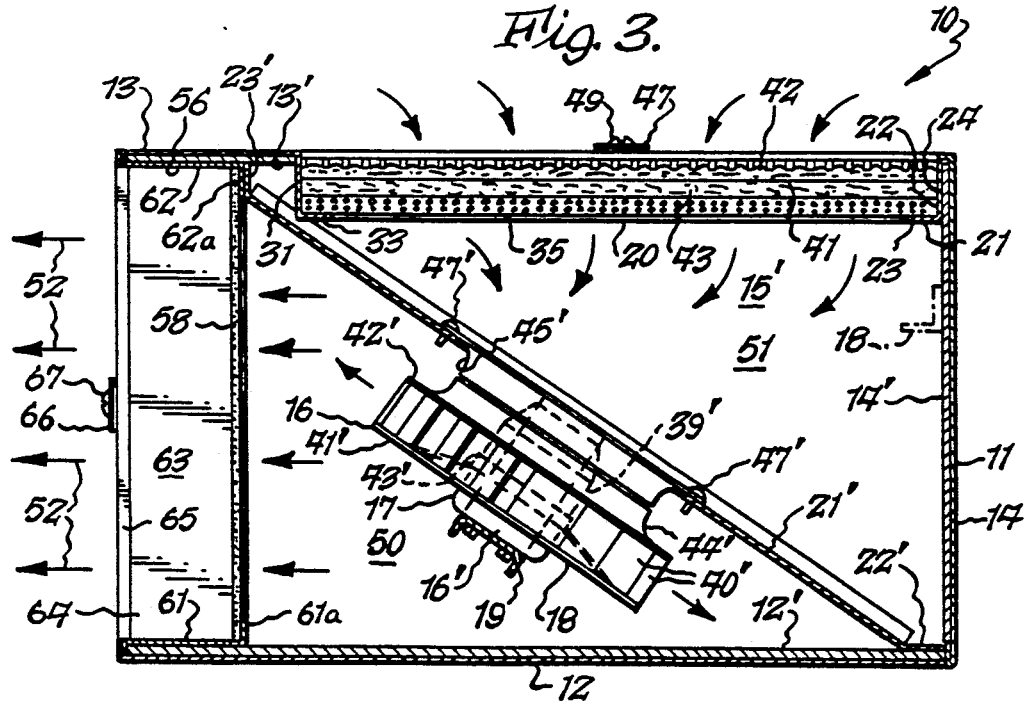

Fig. 6.
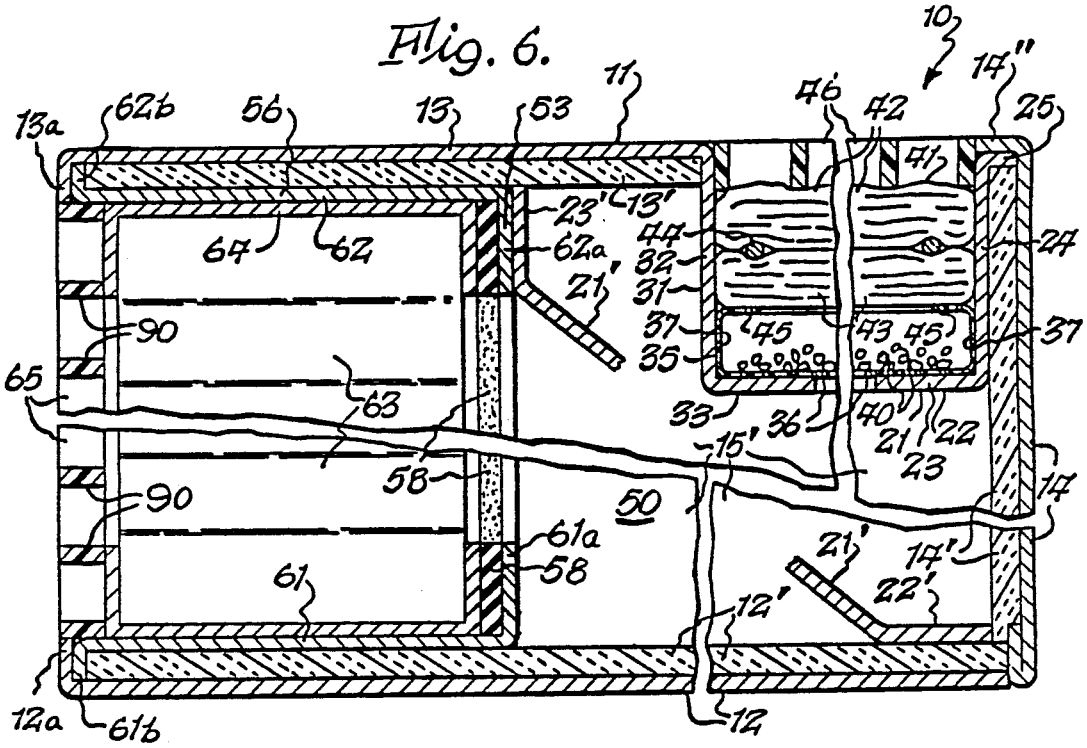
Fig. 7.
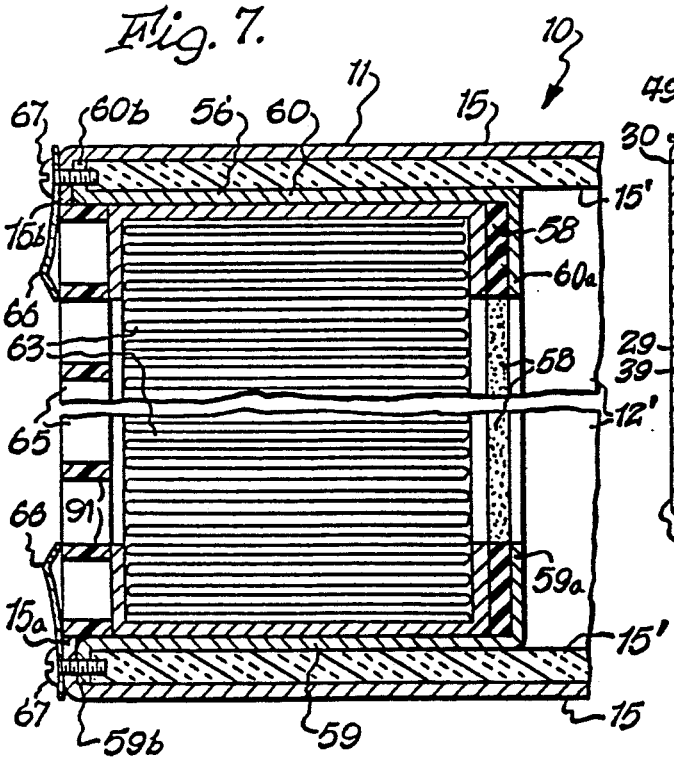
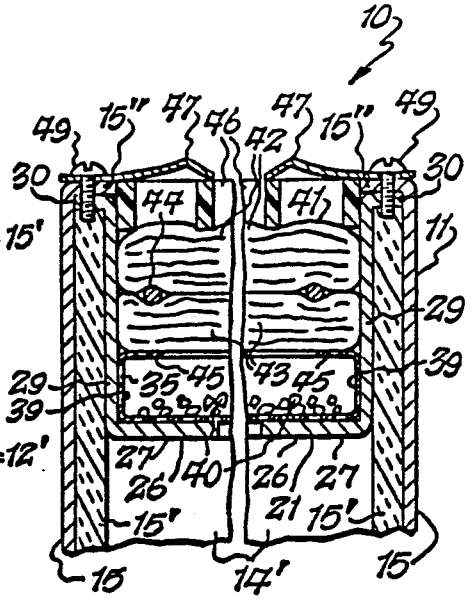
Fig. 8.

Fig. 9.
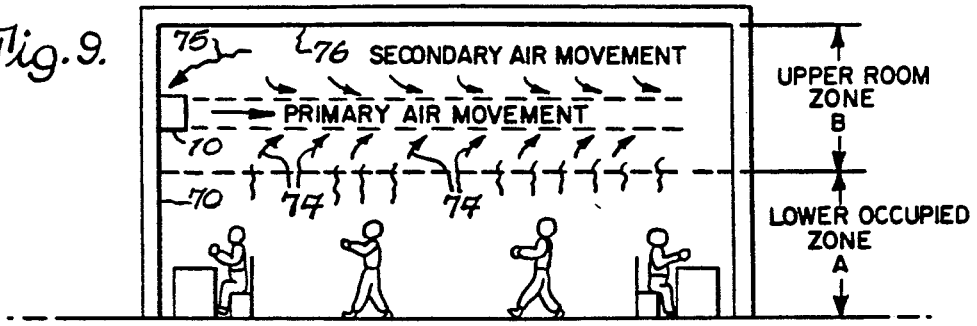
Fig. 10.
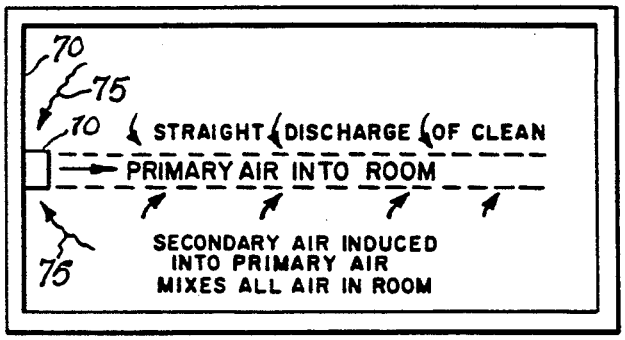
Fig. 15
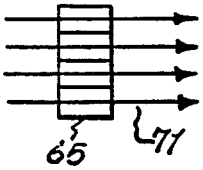
Fig. 12.
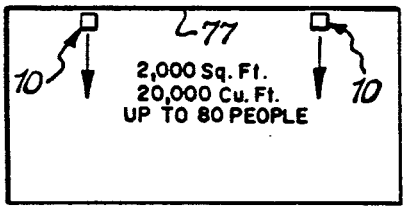
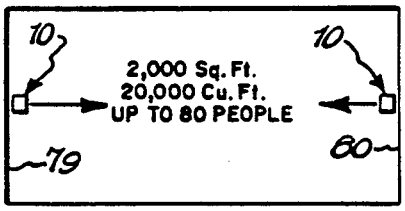
Fig. 11.
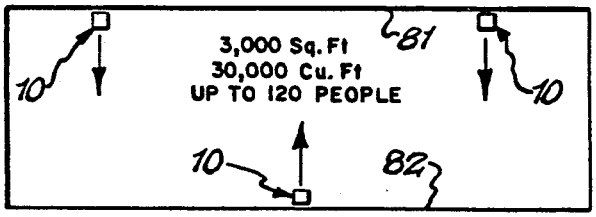
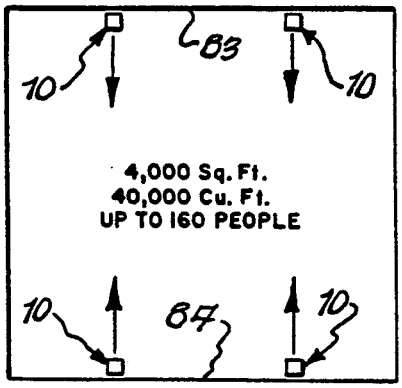
Fig. 13.
Fig. 14.

AIR PURIFICATION UNIT

CROSS REFERENCE TO RELATED APPLICATON

The present invention is an improvement of the air purification unit disclosed in copending application Ser. No. 147,819, filed Jan. 25, 1988, of Donald L. Clark and entitled Air Purification Method and Apparatus.

BACKGROUND OF THE INVENTION

The present invention relates to an improved air purification unit.

In copending application Ser. No. 147,819 an air purification unit is disclosed which utilizes a conventional centrifugal blower having a transition chamber associated therewith for converting the velocity of the blower output to static pressure. It is with an improved air moving construction utilized in apparatus of the foregoing type that the present invention is concerned.

SUMMARY OF THE INVENTION

It is one object of the present invention to provide an improved air moving structure for an air purification unit which does not require a transition chamber to convert air velocity to static pressure and thus simplifies the structure of the unit.

Another object of the present invention is to provide an improved air moving construction for an air purification unit which permits the housing of the unit to be divided into substantially equal inlet and outlet chambers, thereby providing relatively high efficiency of air flow through a relatively small housing.

A further object of the present invention is to provide an improved air moving construction in an air purification unit which occupies a relatively small volume within the housing, thereby permitting the unit to be of a relatively small size.

Yet another object of the present invention is to provide an improved air purification unit having a construction in which the outlet air is propelled substantially by pressure from an air outlet chamber within the unit, thereby contributing to extremely efficient and silent operation. Other objects and attendant advantages of the present invention will readily be perceived hereafter.

The present invention relates to an air purification unit comprising a housing including a top side and a front side, an air inlet in said housing, an air outlet in said housing, a partition in said housing dividing said housing into an air inlet chamber in communication with said air inlet and an air outlet chamber in communication with said air outlet, filter means on said housing for purifying air passing therethrough, and a motorized impeller effectively mounted on said partition for moving air from said inlet chamber to said outlet chamber and pressurizing air in said outlet chamber and forcing air from said outlet chamber.

The various aspects of the present invention will be more fully understood when the following portions of the specification are read in conjunction with the accompanying drawings wherein:

BRIEF DESCRIPTION OF THE DRAWINGS

FIG. 1 is a perspective view of the improved air purifier of the present invention;

FIG. 2 is an exploded view of the air purifier of the present invention;

FIG. 3 is a cross sectional view taken substantially along line 3—3 of FIG. 1;

FIG. 6 is a fragmentary enlarged cross sectional view taken substantially along line 3—3 of FIG. 1;

FIG. 7 is an enlarged fragmentary cross sectional view taken substantially along line 7—7 of FIG. 1;

FIG. 8 is an enlarged fragmentary cross sectional view taken substantially along line 4—4 of FIG. 1;

FIG. 9 is a schematic side elevational view of an occupied room with the improved air purifier of the present invention mounted on a wall thereof;

FIG. 10 is a schematic plan view of the room of FIG. 9 with the occupants removed;

FIG. 11 is a diagrammatic plan view showing how a plurality of improved air purifiers can be mounted within a room;

FIG. 12 is a diagrammatic plan view of a room of the same size of the room of FIG. 11 but showing an alternate mounting arrangement for a plurality of air purifiers;

FIG. 13 is a diagrammatic plan view of a room which is larger than that of FIGS. 11 and 12 and showing how a plurality of improved air purifiers can be mounted within the room;

FIG. 14 is a diagrammatic plan view of a still larger room and showing how a plurality of air purifiers can be mounted therein; and FIG. 15 is a schematic diagram of air flow through the outlet grill.

DESCRIPTION OF THE PREFERRED EMBODIMENTS

Figure 4:
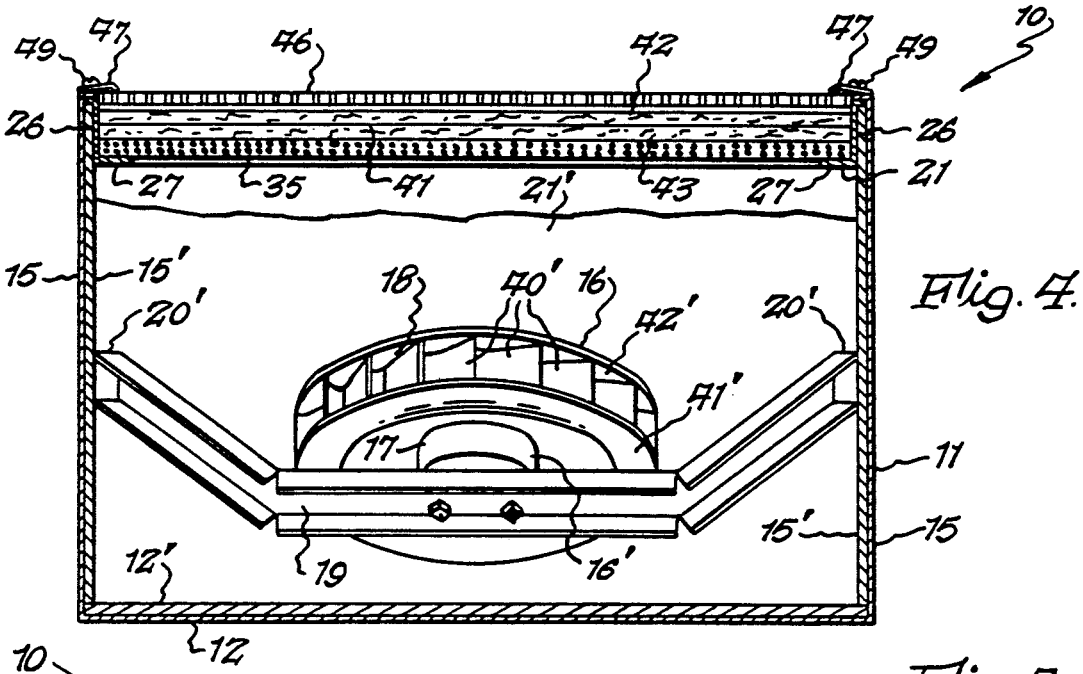
FIG. 4 is a cross sectional view taken substantially along line 4—4 of FIG. 1.

The improved air purifier 10 of the present invention includes a housing 11 having a bottom wall 12, a top wall 13, a rear wall 14 and opposed side walls 15 which are lined with sound absorbing sheet material 12', 13', 14' and 15', respectively.

An air moving unit, which is known as a motorized impeller 16, includes electric motor 17 and an impeller 18. Motor housing portion 16' is mounted on bracket 19 having its opposite ends 20' suitably secured, as by welding, to partition plate 21' which extends diagonally across the housing 11 between side walls 15 (FIGS. 3 and 6) and thus divides the housing into two chambers of substantially equal size. More specifically, a flange 22' at the lower end of plate 21' lies on top of insulation 12' (FIG. 3) and a flange 23' lies along flange 62*a* of filter-receiving frame 56 which is described in detail hereafter.

Figure 5:
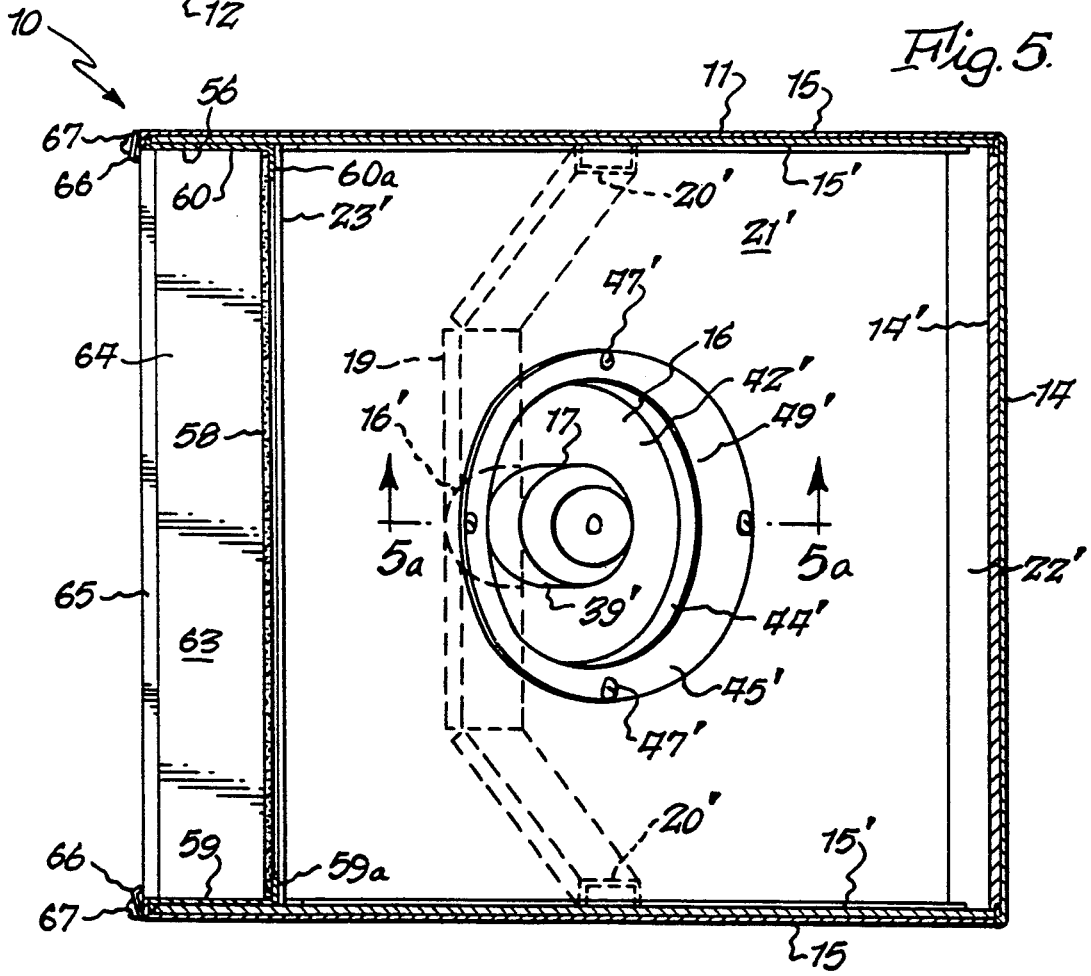
FIG. 5 is a cross sectional view taken substantially along line 5—5 of FIG. 1.
Figure 5A:
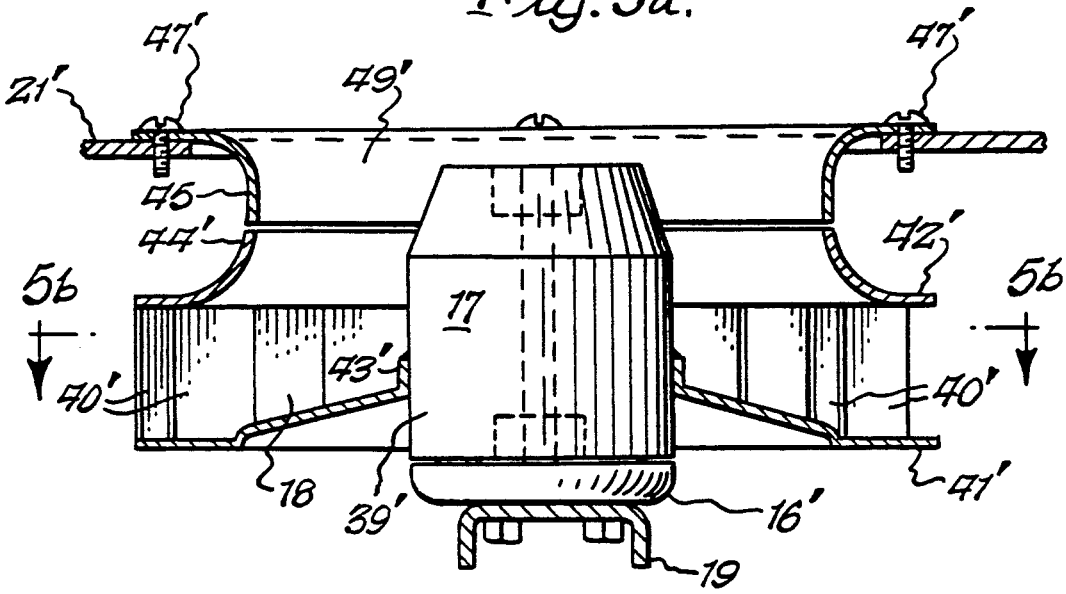
FIG. 5*a* is a fragmentary enlarged cross sectional view taken along line 5*a*—5*a* of FIG. 5.
Figure 5B:
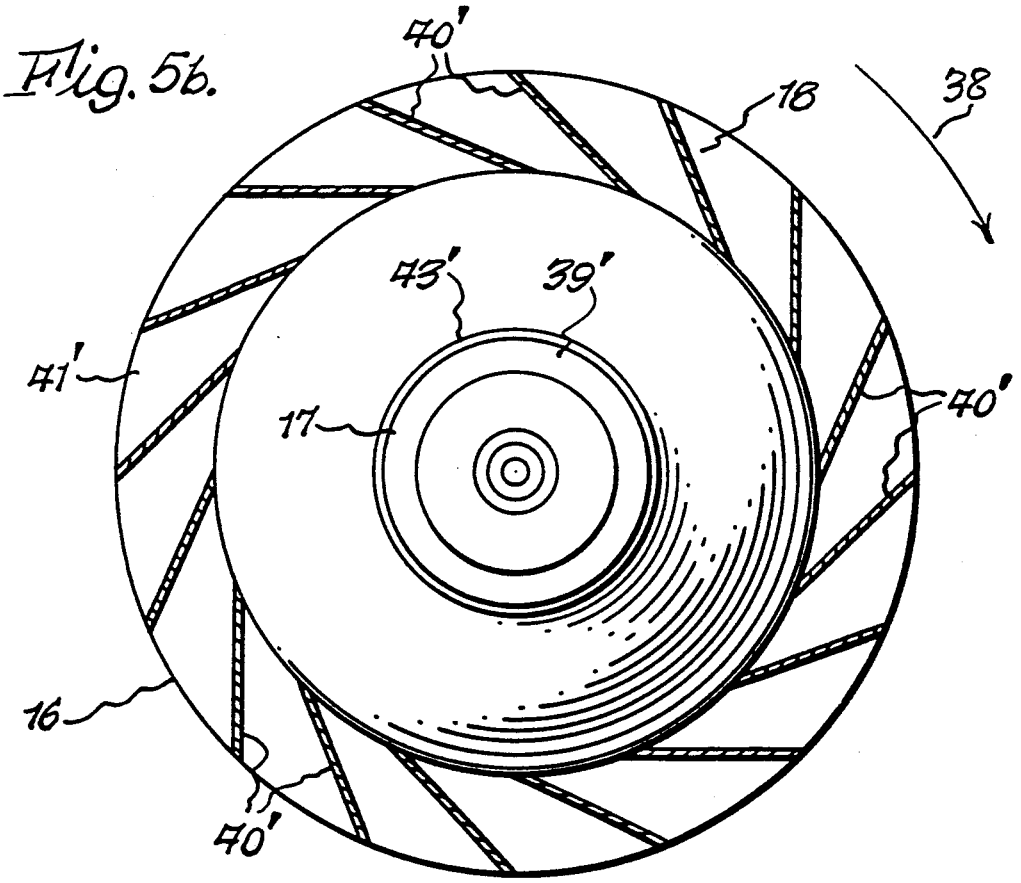
FIG. 5*b* is a cross sectional view taken substantially along line 5*b*—5*b* of FIG. 5*a;*

Motorized impeller 16 also includes a rotatable housing portion 39' (FIG. 5*a*) to which impeller wheel 18 is attached by welding. Impeller blades 40' have their opposite sides fastened between plates 41' and 42'. Plate 41' has an annular flange 43' welded to rotatable motor housing portion 39'. Plate 42' is in the nature of an annular shroud, and its edge 44' is contiguous to stationary annular shroud or inlet ring 45' which is fixedly secured to plate 21' by screws 47' and defines circular inlet opening 49'. Inlet ring 45' induces air smoothly from chamber 51 into the rotating impeller 18 as it rotates in the direction of arrow 38 in FIG. 5*b*, and this is known as backward rotation. Motorized impeller 16 is commercially available and forms no part of the present invention except for the manner in which it coacts with the remainder of the structure of the air purifier 10.

An air inlet opening 20 (FIG. 2) is formed in top wall 13. A frame 21 defines the periphery of opening 20. More specifically, frame 21 includes a plurality of sides in the shape of an S or a Z, depending on how they are viewed in cross section. Frame side 22 (FIGS. 3 and 6) extends substantially the entire distance between side walls 15 and it includes a bottom shelf portion 23 (FIG. 6), a vertical side 24 and an upper flange 25 which is suitably secured to the underside of bent-over portion 14" of rear wall 14, as by welding. Sides 26 (FIGS. 4 and 8) of frame 21 extend along side walls 15 and include lower shelf portions 27, vertical portions 29, and upper flange portions 30 which are secured to the undersides 15" of bent-over side walls 15, as by welding. Frame member 31 (FIG. 6) extends substantially the entire distance between side walls 15 and includes a vertical portion 32 which is a continuation of top wall 13. A horizontal shelf 33 is formed as a continuation of vertical wall 32. Horizontal shelves 23, 27 and 33 have upper surfaces which lie in the same horizontal plane.

A plurality of items are mounted within frame 21. First of all, a removable tray 35 has a perforated bottom 36, the outer edges of which rest on horizontal shelves 23, 27 and 33. Tray 35 also has upstanding pairs of sides 37 and 39 which confine pelletized material 40 within the tray. The pelletized material comprises a second stage filter consisting preferably of activated charcoal and alumina with potassium permanganate for removing gaseous pollutants from the air passing therethrough. A removable prefilter 41 consists of two layers of polyester fabric material 42 and 43 suitably secured to each other and mounted on a rectangular wire frame 44. Filter 41 consists of loose webbonded material, and it functions as a prefilter for removing particulate matter in excess of 1 micron from the air passing therethrough. The underside of filter 41 rests on the upper peripheral horizontal flange 45 of tray 35 and thus also functions to confine the particulate matter 40 within tray 35. A grill 46 fits on top of prefilter 41 and is held in position by tabs or clips 47 which are secured to flanges 15" (FIG. 8) by screws 49. Thus, when motorized impeller 16 is in operation, air will be taken in to housing 11 through grill 46 and it will pass through prefilter 41 and through particulate matter 40 and into inlet chamber 51 and inlet 49' of motorized impeller 16. The prefilter 41 performs the additional function of diffusing the air passing through the particulate bed 40 so that good gas-solid interchange is obtained. The filters 36 and 41 also attenuate any noise from the impeller.

The air being discharged radially outwardly from impeller 18 pressurizes outlet chamber 50 after the air is centrifugally drawn through motorized impeller 16 from chamber 51 on the opposite side of plate 21' from chamber 50. The use of the specific type of motorized impeller 16 eliminates the need for an expansion duct and thus simplifies the construction of unit 10. Furthermore, it has been found that the pressurization of chamber 50 by motorized impeller 16 causes the air to diffuse through the outlet in the direction of arrows 52 (FIG. 3) in a uniformly distributed manner across the entire final filter, thus causing efficient and quiet air flow. The fact that chambers 51 and 50 are of substantially equal size enhances the efficiency of air flow through housing 11. In this respect, if one chamber was smaller than the other, it would have a restrictive effect on the air flow. In addition, the motorized impeller 16 functions to pressurize the air in chamber 50 and thus forces the air uniformly through the outlet substantially by pressure, thereby producing relatively silent operation. In the specific embodiment shown in the drawings, plate 21' is inclined to the horizontal at less than 45°, but any reasonable variation from 45°, either above or below, is acceptable. The impeller 18 may be plastic or metal, and it rotates backwardly with respect to blades 40' to induce air from chamber 51 into chamber 50. The direction of rotation is depicted by arrow 58' in FIG. 5*b*. Motorized impeller 16 is commercially available from ebm Elektrobau Mulfingen GmbH & Co.

A filter-receiving frame 56 is suitably secured within housing 11, as by welding. More specifically, frame 56 includes sides 59, 60, 61 and 62 having flanges 59*a*, 60*a*, 61*a* and 62*a*, respectively. The opposite ends of frame sides 59, 60, 61 and 62 are formed into flanges 59*b*, 60*b*, 61*b* and 62*b*, respectively, which are secured, as by welding, to flanges 15*a*, 15*b*, 12*a* and 13*a* of housing walls 15, 15, 12 and 13, respectively.

A corrugated high efficiency particulate filter element 63 is permanently mounted within a frame 64 which is removably received within frame 56 with a telescopic fit. Thus frame 64 with filter 63 therein are replaceable as a unit within frame 56, as required. A rectangular gasket 58 is located between frame 64 and frame 56, as shown. High efficiency particulate filter 63 traps submicron particles of a size less than 1 micron. This location of filter 63 also further attenuates the air and impeller noise. Essentially, the motorized impeller 16 is placed between two filter banks oriented at a 90° angle to each other by being mounted on partition plate 21' which is at an angle oriented at plus or minus 45°.

An air outlet grill 65 also fits within frame 56 and is retained therein by clips or tabs 66 which are secured to the housing by screws 67. Outlet grille 65 has horizontal dividers or vanes 90 (FIG. 6) and vertical dividers or vanes 91 (FIG. 7). Vanes 90 have perfectly horizontal sides and vanes 91 have perfectly vertical sides to thereby cause the discharged air to approximate a stream of primary air defined by the dotted lines in FIGS. 9 and 10 which induces air into it from the lower occupied zone A (FIG. 9). The flow of primary air from grille 65 is schematically shown in FIG. 15. Stated otherwise, the straight vanes 90 and 91 on the discharge grille prevent the primary air stream from being directed into the lower occupied zone A. The air stream also flows perpendicularly to the room wall (FIGS. 9 and 10), and smoke and odors in the secondary air in lower zone A are drawn up and induced into the purified primary air stream.

A speed control knob 92 is mounted on wall 15 and it functions in conjunction with structure of motor 17 to provide speed control of motorized impeller 16. Thus the speed of motorized impeller 16 can be varied from very low speeds to very high speeds to meet various pollution conditions. In this respect, when there is very little pollution, the motorized impeller 16 can be run at low speed, and when there is high pollution, it can be run at high speed. The use of a speed control is optional.

To install unit 10 on a wall, an angle bracket 18, as shown in phantom in FIG. 3, is normally used. Bracket 18 extends substantially the entire distance between side walls 15. Screws (not shown) extend through the vertical leg of the angle bracket and into a room wall to hold housing side 14 in abutting relationship therewith.

The above described air purifier unit is used to practice the method of air purification described hereafter. One basic way of practicing the method is to install unit 10 on a wall 70 of a room with its rear wall 14 against wall 70 (FIGS. 9 and 10). The bottom wall 12 of the unit should be at least one foot above the highest level of the zone of occupancy, that is, if the highest level a person may reach is 6½ feet above the floor, then the bottom 12 of the housing should be about 7½ feet above the floor. This serves the dual purpose of avoiding direct aiming of the air outlet current at the occupants and also causing the air outlet stream 71 (FIG. 15) to be directed into the upper zone B of the room which may contain smoke particles and other odorous matter which rise into this zone. The discharge is preferably at a velocity of 300 to 500 feet per minute into a room such as depicted in FIGS. 9 and 10. The discharged purified air from outlet grill 65, which constitutes a primary air stream, substantially in the shape of a column, is schematically shown within the parallel dotted-lines emanating from the unit 10 in FIGS. 9 and 10. This column is directed into the upper zone B, and it performs a plurality of functions. In this respect, it induces secondary yet uncleaned air from the lower occupied zone A into the primary clean air stream in upper room zone B, as depicted by arrows 74 in FIG. 9, and it displaces and disperses the secondary air mass in zone B, as schematically depicted by the arrows in FIG. 10, thereby performing a constant removal of polluted air rising and induced from lower zone A without creating an appreciable draft therein.

The air which is returned to unit 10 is depicted by arrows 75, and this air enters unit 10 through inlet grill 46 which is facing the ceiling 76. The inlet grill should be spaced at least about 6 inches from ceiling 76 to permit removal and replacement of the first stage filter 41 and the second stage filter 36. The fact that the air inlet grill faces the ceiling, thus directs impeller noise in this direction and away from the occupants. Furthermore, the motorized impeller noise is attenuated because of the muffling action of the first and second stage filters. Furthermore, the sound insulation 12', 13', 14' and 15' also absorbs the motorized impeller noise.

The first stage filter 41, as noted above, is fabricated of non-woven polyester material, or other suitable filter media, and it traps particulate matter above the 1.0 micron range. The second stage filter consists of pelletized material in tray 35, as noted above, and it may be an activated carbon or alumina and potassium permanganate blend or other combinations of adsorbents and absorbents for removing odorous and gaseous contaminants which include but are not limited to gaseous chemicals found in smoke, body odors, food odors, chemical odors and the like which are normally experienced in occupied rooms such as commercial gathering places, offices, banquet rooms, board rooms, cafeterias, laboratories, and other places where tobacco smoke and other odors are generated.

The partially purified air which has thus passed through the first and second stage filters for the above-described purification steps, is then induced into motorized impeller 16 from which it passes into chamber 50 and is forced through third stage filter 63 which is a corrugated high efficiency particulate filter which traps submicron particles below the 1 micron size. This filter may have other efficiency ratings and should be selected for the particular need. This filter also aids in attenuating the impeller noise. Generally a HEPA filter is used which removes at least 95% of all particles 0.3 microns in size. However, filters of less efficiency may be used.

The purified air which is thus discharged from outlet grill 65 as depicted at 71, thus causes the above-described cycle to be repeated. Considering, for example, that the unit 10 purifies approximately 1,000 cubic feet per minute in a room such as depicted in FIGS. 9 and 10 having 10,000 cubic feet, it can readily be seen that the entire air volume within the room is passed through the air purifier in 10 minutes in this case. The unit 10 is capable of removing approximately 95% of all contaminants in the air passing therethrough, and thus a relatively high degree of air purification is achieved.

In FIG. 11 the placement of a plurality of units 10 having the above capacity are depicted on wall 77 of a room which may have 2,000 square feet and 20,000 cubic feet and contain up to about 80 people. An alternate arrangement for a room of the size depicted in FIG. 11 is shown in FIG. 12 wherein a unit 10 is mounted on each of two opposing walls 79 and 80. FIG. 13 depicts the placement of a plurality of units 10 in a room which may contain 3,000 square feet and 30,000 cubic feet and have up to about 120 people therein. In a room of this size two units 10 may be placed on one wall 81 to direct their output toward opposing wall 82. The two units 10 on wall 81 are spaced in such a manner so that the unit 10 on wall 82 directs its air to the midpoint between the units 10 on wall 81. In FIG. 14 an arrangement of units 10 is shown for a room which may contain 4,000 square feet and 40,000 cubic feet and be occupied by up to about 160 people. In a room of this size, two units 10 may be mounted on wall 83 and two units 10 may be mounted on opposite wall 84 and have their outputs directed toward wall 83, as shown. It will be appreciated that purifier units of different capacities than unit 10 described above can be used in different quantities and/or in different placement arrangements. The purifier units can be built in different sizes to match specific capacity requirements.

While in the above description the tray of pelletized material has been shown as removable from the top of the housing, it will be appreciated that the housing can be modified to permit installation and removal of the tray from the front or the side.

It can thus be seen that the improved method and apparatus for effecting purification of contaminated air in a room is manifestly capable of achieving the above-described objects, and while preferred embodiments have been disclosed, it will be appreciated that the present invention is not limited thereto but may be otherwise embodied within the scope of the following claims.

What is claimed is:

1. An air purification unit comprising a housing of substantially rectangular configuration including a plurality of sides, an air inlet in one of said sides, an air outlet in another of said sides, a diagonal partition in said housing dividing said housing into an air inlet chamber in communication with said air inlet and an air outlet chamber in communication with said air outlet, an opening in said partition, filter means in said housing for purifying air passing therethrough, and a motorized impeller assembly effectively mounted on said partition for moving air from said inlet chamber to said outlet chamber through said opening and pressurizing air in said outlet chamber and forcing air from said outlet chamber through said air outlet, said motorized impeller assembly including a rotatable fan housing portion and a stationary housing portion, bracket means secured to said stationary housing portion for fixedly mounting said impeller in said air outlet chamber, a shroud, means fixedly mounting said shroud at said opening for guiding air passing from said inlet chamber to said outlet chamber through said opening, an impeller fixedly secured to said rotatable fan housing portion, said impeller including an inlet shroud located in contiguous relationship to said shroud for receiving air from said shroud, said impeller also including a plate spaced from said inlet shroud and a plurality of blades affixed between said inlet shroud and said plate.

2. An air purification unit as set forth in claim 1 wherein said inlet and outlet chambers are of substantially equal size.

3. An air purification unit as set forth in claim 1 wherein said filter means includes first filter means in said air inlet, and second filter means in said air outlet.

4. An air purification unit as set forth in claim 3 wherein said housing includes a top side and a front side adjacent thereto, and wherein said air inlet is in said top side of said housing, and wherein said air outlet is in said front side.

5. An air purification unit as set forth in claim 4 wherein said first filter means includes a tray of pelletized air purifying material.

6. An air purification unit as set forth in claim 5 wherein said first filter means includes material for trapping particulate matter.

7. An air purification unit as set forth in claim 6 wherein said second filter means comprises a high efficiency particulate filter.

8. An air purification unit as set forth in claim 7 wherein said air outlet includes a grille for moving the outlet air in a substantially columnar shape.

9. An air purification unit as set forth in claim 1 wherein said housing includes a top side and a front side adjacent thereto, and wherein said air inlet is in said top side of said housing, and wherein said air outlet is in said front side.

10. An air purification unit comprising a housing including a top side and a front side, an air inlet in said top side, an air outlet in said front side oriented at substantially 90° to said air inlet, a diagonal partition in said housing dividing said housing into an air inlet chamber in communication with said air inlet and an air outlet chamber in communication with said air outlet, filter means in said housing for purifying air passing therethrough, and air moving means effectively mounted on said partition for moving air from said inlet chamber to said outlet chamber and pressurizing air in said outlet chamber and forcing air from said outlet chamber through said outlet substantially only by pressure.

11. An air purification unit as set forth in claim 10 wherein said inlet and outlet chambers are of substantially equal size.

12. An air purification unit as set forth in claim 10 wherein said filter means comprise first filter means in said air inlet, and second filter means in said air outlet.

13. An air purification unit as set forth in claim 12 wherein said first filter means comprises a tray of pelletized air purifying material.

14. An air purification unit as set forth in claim 13 wherein said first filter means includes material for trapping particulate matter.

15. An air purification unit as set forth in claim 14 wherein said second filter means comprises a high efficiency particulate filter.

16. An air purification unit comprising a housing including a plurality of sides, an air inlet in one of said sides, an air outlet in another of said sides, a diagonal partition in said housing dividing said housing into an air inlet chamber in communication with said air inlet and an air outlet chamber in communication with said air outlet, filter means in said housing for purifying air passing therethrough, and air moving means effectively mounted on said diagonal partition for moving air from said inlet chamber to said outlet chamber and pressurizing air in said outlet chamber and forcing air from said outlet chamber through said outlet substantially only by pressure.

17. An air purification unit as set forth in claim 16 wherein said inlet and outlet chambers are of substantially equal size.

* * * * *